US005901571A

United States Patent [19]

Whaley

[11] Patent Number: 5,901,571

[45] Date of Patent: May 11, 1999

[54] PORTABLE BEVERAGE CARRIER

[76] Inventor: Mark A. Whaley, 101 Bavarian Dr. Apt M, Middletown, Ohio 45044

[21] Appl. No.: 09/010,758

[22] Filed: Jan. 22, 1998

[51] Int. Cl.[6] ..... F25D 3/08

[52] U.S. Cl. ..... 62/457.5; 62/530

[58] Field of Search ..... 62/457.5, 457.4, 62/457.7, 371, 530

[56] References Cited

U.S. PATENT DOCUMENTS

| | | | |
|---|---|---|---|
| 3,262,283 | 7/1966 | Taylor | 62/457.7 |
| 4,324,111 | 4/1982 | Edwards | 62/457.5 |
| 4,628,705 | 12/1986 | Nave | 62/457.5 |
| 5,024,067 | 6/1991 | Maier | 62/457.4 |
| 5,215,208 | 6/1993 | Jackson | 220/516 |
| 5,257,509 | 11/1993 | Harris | 62/326 |
| 5,758,513 | 6/1998 | Smith | 62/457.5 |

*Primary Examiner*—William Doerrler

[57] ABSTRACT

A new portable beverage carrier for transporting beverages while keeping them at a constant temperature for long periods of time. The inventive device includes a case and a cooler insert member. The case functions as a suitcase and includes a base, a top hingedly secured to the base, and a latching means. The cooler insert member is disposed within a hollow interior of the case base and includes a plurality of beverage container receiving cavities. The cooler insert member is collapsible for convenient storage.

13 Claims, 2 Drawing Sheets

PORTABLE BEVERAGE CARRIER

BACKGROUND OF THE INVENTION

1. Field of the Invention

The present invention relates to food and beverage containers and more particularly pertains to a new portable beverage carrier for transporting beverages while keeping them at a constant temperature for long periods of time.

2. Description of the Prior Art

The use of food and beverage containers is known in the prior art. More specifically, food and beverage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art food and beverage containers include U.S. Pat. No. 4,106,597; U.S. Pat. No. 4,662,188; U.S. Pat. No. Des. 330,513; U.S. Pat. No. 5,257,509; U.S. Pat. No. 4,344,301; and U.S. Pat. No. 4,858,444.

While these devices fulfill their respective, particular objectives and requirements, the aforementioned patents do not disclose a new portable beverage carrier. The inventive device includes a case and a cooler insert member. The case functions as a suitcase and includes a base, a top hingedly secured to the base, and a latching means. The cooler insert member is disposed within a hollow interior of the case base and includes a plurality of beverage container receiving cavities. The cooler insert member is collapsible for convenient storage.

In these respects, the portable beverage carrier according to the present invention substantially departs from the conventional concepts and designs of the prior art, and in so doing provides an apparatus primarily developed for the purpose of transporting beverages while keeping them at a constant temperature for long periods of time.

SUMMARY OF THE INVENTION

In view of the foregoing disadvantages inherent in the known types of food and beverage containers now present in the prior art, the present invention provides a new portable beverage carrier construction wherein the same can be utilized for transporting beverages while keeping them at a constant temperature for long periods of time.

The general purpose of the present invention, which will be described subsequently in greater detail, is to provide a new portable beverage carrier apparatus and method which has many of the advantages of the food and beverage containers mentioned heretofore and many novel features that result in a new portable beverage carrier which is not anticipated, rendered obvious, suggested, or even implied by any of the prior art food and beverage containers, either alone or in any combination thereof.

To attain this, the present invention generally comprises a case and a cooler insert member. The case functions as a suitcase and includes a base, a top hingedly secured to the base, and a latching means. The cooler insert member is disposed within a hollow interior of the case base and includes a plurality of beverage container receiving cavities. The cooler insert member is collapsible for convenient storage.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable beverage carrier apparatus and method which has many of the advantages of the food and beverage containers mentioned heretofore and many novel features that result in a new portable beverage carrier which is not anticipated, rendered obvious, suggested, or even implied by any of the prior art food and beverage containers, either alone or in any combination thereof.

It is another object of the present invention to provide a new portable beverage carrier which may be easily and efficiently manufactured and marketed.

It is a further object of the present invention to provide a new portable beverage carrier which is of a durable and reliable construction.

An even further object of the present invention is to provide a new portable beverage carrier which is susceptible of a low cost of manufacture with regard to both materials and labor, and which accordingly is then susceptible of low prices of sale to the consuming public, thereby making such portable beverage carrier economically available to the buying public.

Still yet another object of the present invention is to provide a new portable beverage carrier which provides in the apparatuses and methods of the prior art some of the advantages thereof, while simultaneously overcoming some of the disadvantages normally associated therewith.

Still another object of the present invention is to provide a new portable beverage carrier for transporting beverages while keeping them at a constant temperature for long periods of time.

Yet another object of the present invention is to provide a new portable beverage carrier which includes a case and a cooler insert member. The case functions as a suitcase and includes a base, a top hingedly secured to the base, and a latching means. The cooler insert member is disposed within a hollow interior of the case base and includes a plurality of beverage container receiving cavities. The cooler insert member is collapsible for convenient storage.

Still yet another object of the present invention is to provide a new portable beverage carrier that has at least one removable cooler insert member that may be compressed to more easily fit within a cooling or heating means.

Even still another object of the present invention is to provide a new portable beverage carrier that has the external appearance of a suitcase.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
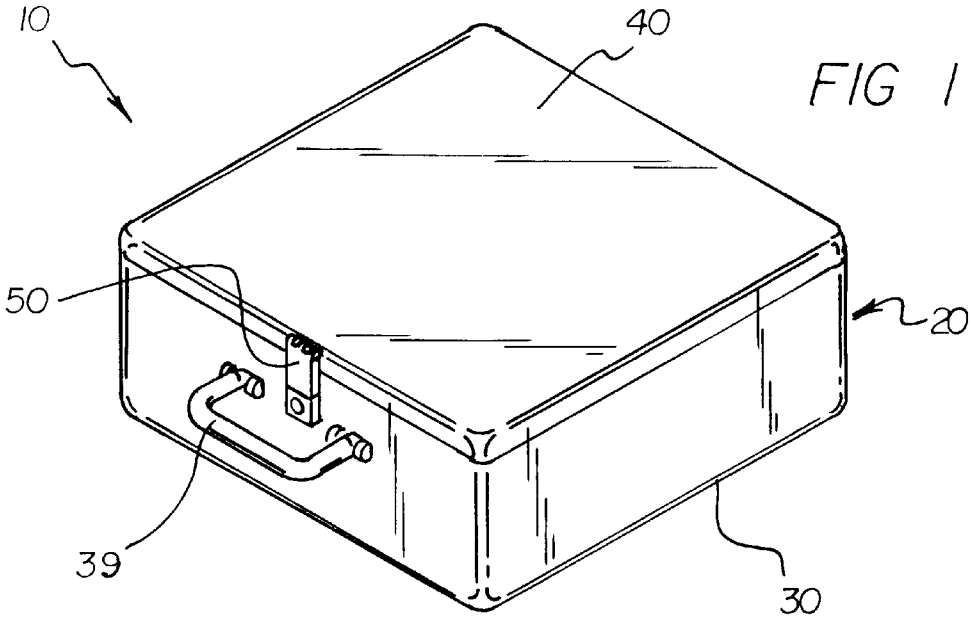
FIG. 1 is a perspective view of a new portable beverage carrier in the closed position according to the present invention.

With reference now to the drawings, and in particular to FIGS. 1 through 4 thereof, a new portable beverage carrier embodying the principles and concepts of the present invention and generally designated by the reference numeral 10 will be described.

As best illustrated in FIGS. 1 through 4, the portable beverage carrier 10 comprises a case 20 and a cooler insert member 60. The case 20 functions as a suitcase and includes a base 30, a top 40 hingedly secured to the base 30, and a latching means 50. The cooler insert member 60 is disposed within a hollow interior 32 of the case base 30 and includes a plurality of beverage container receiving cavities 64. The cooler insert member 60 is collapsible for convenient storage.

The base 30 of the case 20 has a hollow interior 32 and an upper opening 33 into the hollow interior 32. The top 40 of the case 20 has a hollow interior 42 and a lower opening 44 into the top hollow interior 42. The top 40 is hingedly secured to the base 30 along co-extensive edges 34, 46 of the top 40 and base 30. The top lower opening 44 faces the base upper opening 33. The latching means 50 selectively holds the base 30 and the top 40 in a closed position.

Preferably, the base 30 has a front wall 36, a back wall (not shown), and a pair of opposing side walls 38. Ideally, the front 36, back, and side 38 walls are insulated to help prevent the passage of heat, as may be the top 40. The base 30 may also include a carrier handle 39.

The cooler insert member 60 has an upper surface 62 with a plurality of beverage container receiving cavities 64 extending into the upper surface 62. The cooler insert member 60 is disposed within the base hollow interior 32 with the upper surface 62 facing the case top 40.

Figure 4:
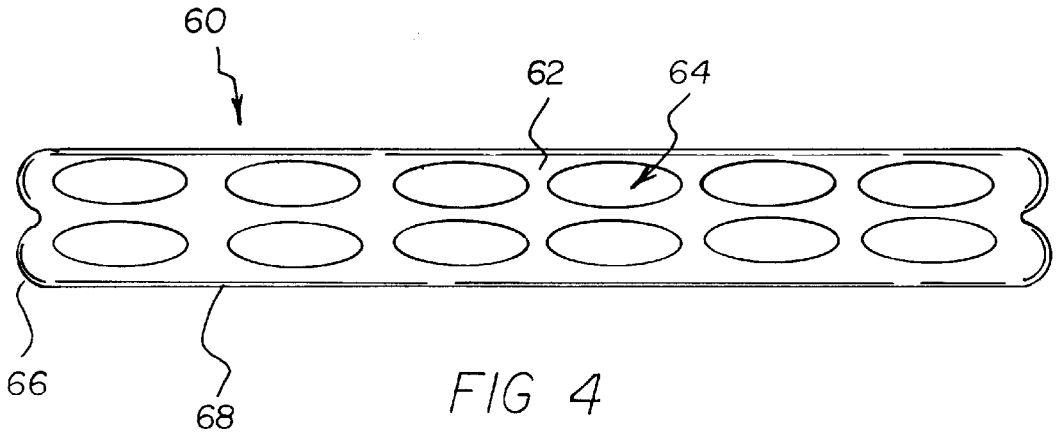
FIG. 4 is a side view of the present invention illustrating the collapsible nature of the cooler insert member.

Preferably, the cooler insert member 60 has a pair of lateral sides 66 and a pair of longitudinal sides 68. Each lateral side 66 is positioned adjacent to a base side wall 38, while the longitudinal sides 68 are substantially parallel to the base front wall 36 and base back wall. As seen in FIG. 4, the cooler insert member 60 is collapsible along the lateral sides 66. As shown in FIG. 4, the longitudinal sides 68 of the cooler insert member 60 are positioned more closely together when the cooler insert member 60 is collapsed than when it is not. The container receiving cavities 64 deform and each of the lateral sides 66 bulge out to accommodate the gel.

Figure 3:
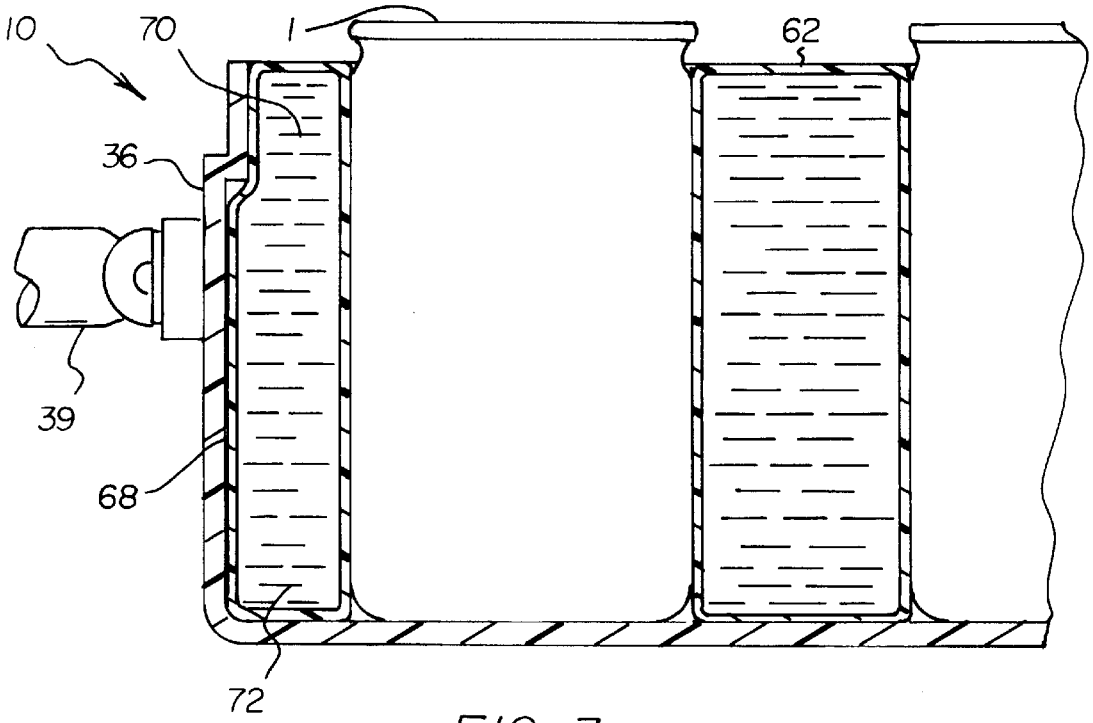
FIG. 3 is a cross sectional view of the present invention taken along line 3—3 of FIG. 2.

Also preferably, as illustrated in FIG. 3, the cooler insert member 60 has an interior 70 which may or may not be hollow. A gel 72 of a type known in the art is provided within the interior 70 that allows the cooler insert member 60 to be heated and cooled so that it retains a nearly constant temperature for a number of hours. Ideally, the gel 72 is of a type that does not solidify at temperatures from 32° F. down to about −20° F. so that the cooler insert member 60 may be collapsed and cooled at temperatures below the freezing point of water, yet remain pliable enough to be inserted into the base hollow interior 32 for use.

Figure 2:
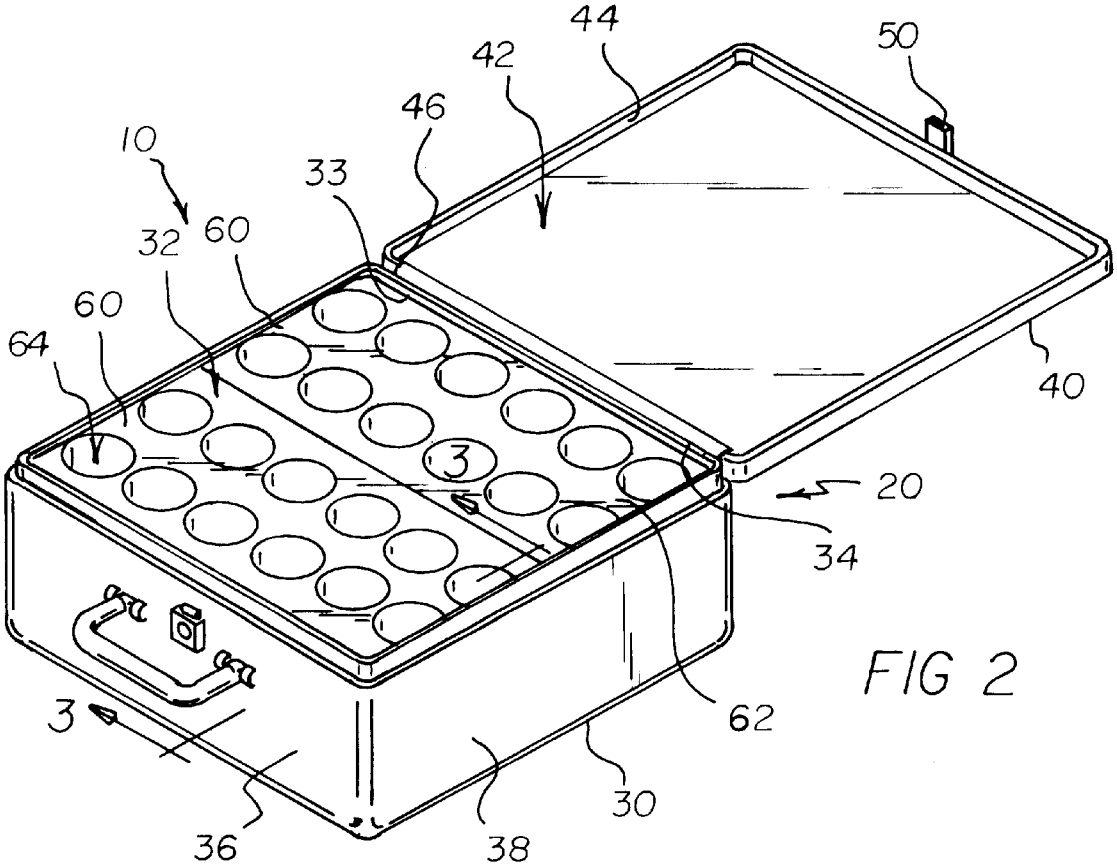
FIG. 2 is a perspective view of the present invention in the open position.

Optionally, the portable beverage carrier 10 may include a plurality of cooler insert members 60. In such an embodiment, the cooler insert members 60 are preferably positioned adjacent each other along the cooler insert member longitudinal sides 68. FIG. 2 illustrates the portable beverage carrier 10 with two cooler insert members 60.

In use, the cooler insert member 60 may be removed from the base hollow interior 32 and placed in a cooling means (not shown) such as a refrigerator or freezer to cool. The cooler insert member 60 may be collapsed, as in FIG. 4, to be more conveniently placed within the cooling means. Once the cooler insert member 60 is cooled to the desired temperature, it is placed within the base hollow interior 32. As shown in FIG. 3, beverage containers 1 may be placed within the beverage container receiving cavities 64. The gel 72 helps maintain a nearly constant temperature within the portable beverage carrier 10, or helps cool warmer beverages contained in beverage containers 1. Optionally, the entire portable beverage carrier 10 may be placed within a cooling means to cool.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable beverage carrier, comprising:

a case including:

a base having a hollow interior and an upper opening into said base hollow interior;

a top having a hollow interior and a lower opening into said top hollow interior, said top being hingedly secured to said base along co-extensive edges, said top lower opening facing said base upper opening;

a latching means for selectively holding said base and said top in a closed position; and a cooler insert member having an upper surface, said cooler insert member upper surface having a plurality of beverage carrier receiving cavities being extended therein, said cooler insert member being disposed within said base hollow interior, said cooler insert member upper surface facing said top, said cooler insert member being collapsible for convenient storage of said cooler insert member when removed from said base hollow interior.

2. The portable beverage carrier of claim 1, wherein said base has a front wall, a back wall, and a pair of opposing side walls, and wherein said cooler insert member has a pair of lateral sides and a pair of longitudinal sides, each said cooler insert member lateral side being positioned adjacent to a said base side wall, said cooler insert longitudinal sides being substantially parallel to said base front wall and said base back wall.

3. The portable beverage carrier of claim 1, wherein there are a plurality of cooler insert members.

4. The portable beverage carrier of claim 3, wherein said base has a front wall, a back wall, and a pair of opposing side walls, and wherein each said cooler insert member has a pair of lateral sides and a pair of longitudinal sides, each said cooler insert member lateral sides being positioned adjacent to a said base side wall, each said cooler insert longitudinal sides being substantially parallel to said base front wall and said base back wall.

5. The portable beverage carrier of claim 4, wherein said cooler insert members are positioned adjacent each other along their said cooler insert member longitudinal sides.

6. The portable beverage carrier of claim 1, wherein said cooler insert member has an interior, said cooler insert member interior having a gel being provided therein allowing said cooler insert member to be heated and cooled and to retain nearly constant temperature for a number of hours.

7. The portable beverage carrier of claim 1, wherein said base member has a carrier handle.

8. A portable beverage carrier, comprising:

a case including:

a base having a front wall, a back wall, and a pair of opposing side walls, a hollow interior, an upper opening into said base hollow interior, and a carrying handle;

a top having an hollow interior and a lower opening into said top hollow interior, said top being hingedly secured to said base along co-extensive edges, said top lower opening facing said base upper opening;

a latching means for selectively holding said base and said top in a closed position;

a pair of cooler insert members each having a hollow interior, an upper surface, a pair of lateral sides, and a pair of longitudinal sides, said cooler insert upper surface having a plurality of circular beverage container receiving cavities being extended therein, each said cooler insert member being disposed within said base hollow interior, said cooler insert member upper surface facing said top, each said cooler insert member lateral sides being positioned adjacent to a said base side wall, said cooler insert longitudinal sides being substantially parallel to said base front wall and said base back wall, each said cooler insert member hollow interior having a gel being provided therein allowing said cooler insert members to be heated and cooled and to retain nearly constant temperature for a number of hours, each said cooler insert member being collapsible along said lateral sides for convenient storage of said cooler insert member when removed from said base hollow interior;

wherein each of said beverage carrier receiving cavities has a generally cylindrical peripheral sidewall;

wherein each of said peripheral sidewalls of said beverage carrier receiving cavities is substantially perpendicular to said upper surface of said cooler insert member;

wherein each of said beverage carrier receiving cavities extends through a lower surface of said cooler insert member; and wherein said gel remains in a fluid state between temperatures from 32° Fahrenheit and about −20° Fahrenheit.

9. The portable beverage carrier of claim 1, wherein each of said beverage carrier receiving cavities has a generally cylindrical peripheral sidewall.

10. The portable beverage carrier of claim 9, wherein each of said peripheral sidewalls of said beverage carrier receiving cavities is substantially perpendicular to said upper surface of said cooler insert member.

11. The portable beverage carrier of claim 1, wherein each of said beverage carrier receiving cavities extends through a lower surface of said cooler insert member.

12. The portable beverage carrier of claim 9, wherein each of said beverage carrier receiving cavities extends through a lower surface of said cooler insert member.

13. The portable beverage carrier of claim 6, wherein said gel remains in a fluid state between temperatures from 32° Fahrenheit and about −20° Fahrenheit.

* * * * *